US005242342A

United States Patent [19]

Silverman

[11] Patent Number: 5,242,342

[45] Date of Patent: Sep. 7, 1993

[54] AEROBIC AND ISOMETRIC EXERCISE APPARATUS

[75] Inventor: John Silverman, El Paso, Tex.

[73] Assignee: Bi-Robic Conditioning Systems, Inc., El Paso, Tex.

[21] Appl. No.: 909,928

[22] Filed: Jul. 7, 1992

[51] Int. Cl.[5] ..... A63B 22/00; A63B 23/10; A63B 21/06; A63B 21/002

[52] U.S. Cl. ..... 482/54; 482/79; 482/91; 482/94; 482/110; 482/132; 482/143

[58] Field of Search ..... 482/54, 79, 91, 93, 482/94, 110, 132, 133, 143, 148; 472/127

[56] References Cited

U.S. PATENT DOCUMENTS 1,211,765 1/1917 Schmidt .
2,135,082 11/1938 Kelly ..... 482/54
3,379,434 4/1968 Guzaldo ..... 482/143
3,379,437 4/1968 Warner .
3,633,905 1/1972 Etchelecou ..... 472/127
3,650,529 3/1972 Salm et al. .
3,887,179 6/1975 Klepper et al. .
4,126,326 11/1978 Phillips .
4,342,452 8/1982 Summa .
4,865,313 9/1989 Kuo .

*Primary Examiner*—Richard J. Apley
*Assistant Examiner*—Lynne A. Reichard

[57] ABSTRACT

An apparatus for simultaneous isometric and aerobic exercising having a base, a vertical upright, vertically adjustable handlebars on the upright, and a weighted cylinder not aligned vertically with the handlebars to be rotated with the feet while supporting the body from the handlebars.

5 Claims, 4 Drawing Sheets

AEROBIC AND ISOMETRIC EXERCISE APPARATUS

FIELD OF THE INVENTION

This invention relates to exercise machines, and more particularly, to machines for performing combined isometric and aerobic exercises.

BACKGROUND OF THE INVENTION

Various exercise devices exist for toning, developing or working the lower extremities such as treadmills, stair-climber devices and stationary bicycles. Weight-lifting and other multi-station resistance exercise equipment exist to provide a total muscle development workout at a number of stations. These pieces of equipment generally are designed to work out one major group of muscles at a time such as the arms, the back, the legs, etc. at different individual stations.

The prior art equipment for multi-position or multi-station exercises has been bulky and expensive and requires considerable space for the entire equipment layout. There are smaller pieces of equipment that provide either a muscular workout or an aerobic workout. A need has been present for a compact piece of exercise equipment which provides the means for combined isometric or muscular workout and aerobic cardiovascular conditioning and which works several major muscle groups as well as the cardiovascular system at the same time during the workout.

SUMMARY OF THE INVENTION

The invention is an apparatus for combined isometric and aerobic exercising which includes means for supporting a major portion of the weight of an exercising person by his arms and an aerobic leg exercising means offset horizontally from the supporting means. A preferred embodiment includes a base, a vertical upright supported by the base, generally horizontal handlebars adjustable vertically with respect to the base, and a weighted cylinder journal for rotation on and supported by the base for manipulation with the feet of a person performing the exercise routine. The cylinder is not vertically aligned with any portion of the handlebars in order to create complete isometric tension during performance and may be moved to a variety of fixed positions toward and away from the vertical upright. A major portion of the weight of the person exercising is carried by the handlebars. The handlebars may be moved to upper and lower positions to support the exercising person's weight above, below or partially above and partially below the handlebars in different exercise postures while manipulating or rotating the cylinder. The varied positions and locations of the handlebars in relation to the cylinder creates more or less isometric tension during performance.

BRIEF DESCRIPTION OF THE DRAWINGS

Reference is now made to the drawings, in which.

DESCRIPTION OF THE PREFERRED EMBODIMENT

Figure 2:
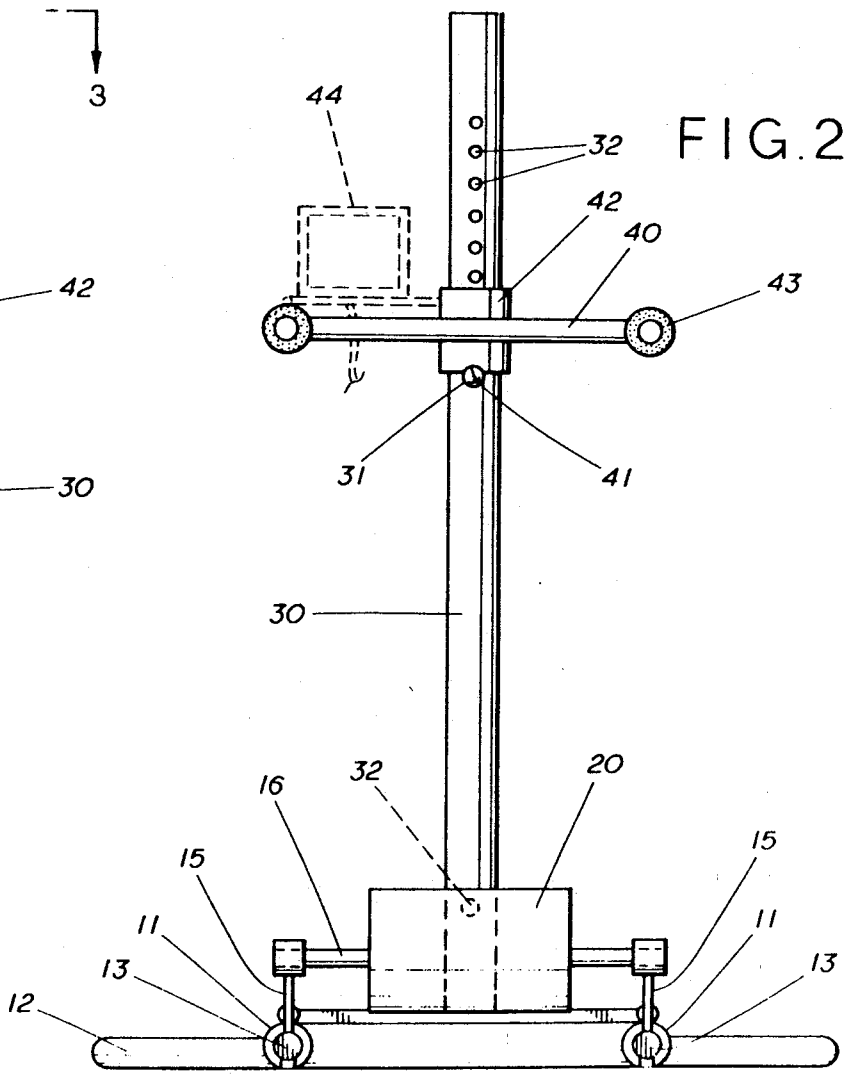
FIG. 2 is a front elevation view of the apparatus.
Figure 1:
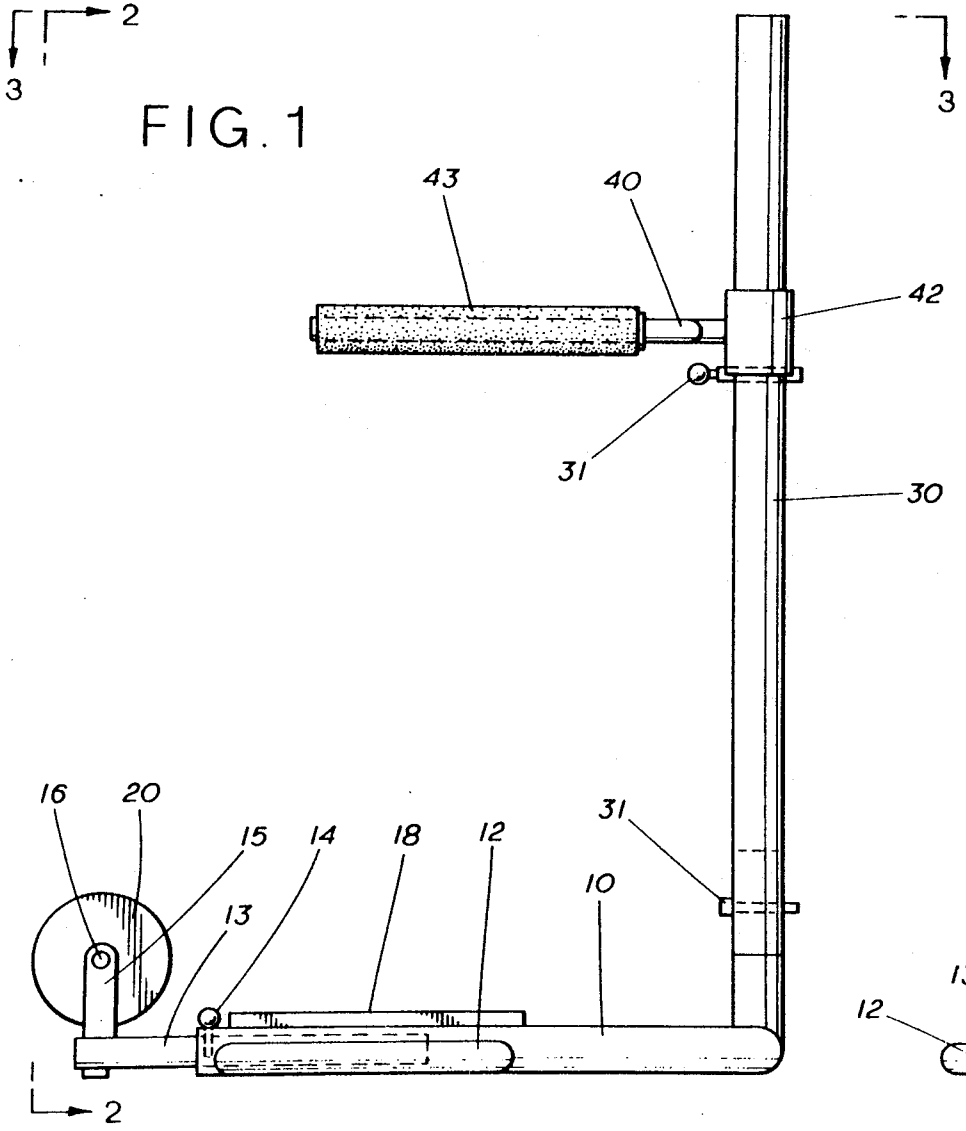
FIG. 1 is a side elevation view of the preferred embodiment of the exercise apparatus.
Figure 3:
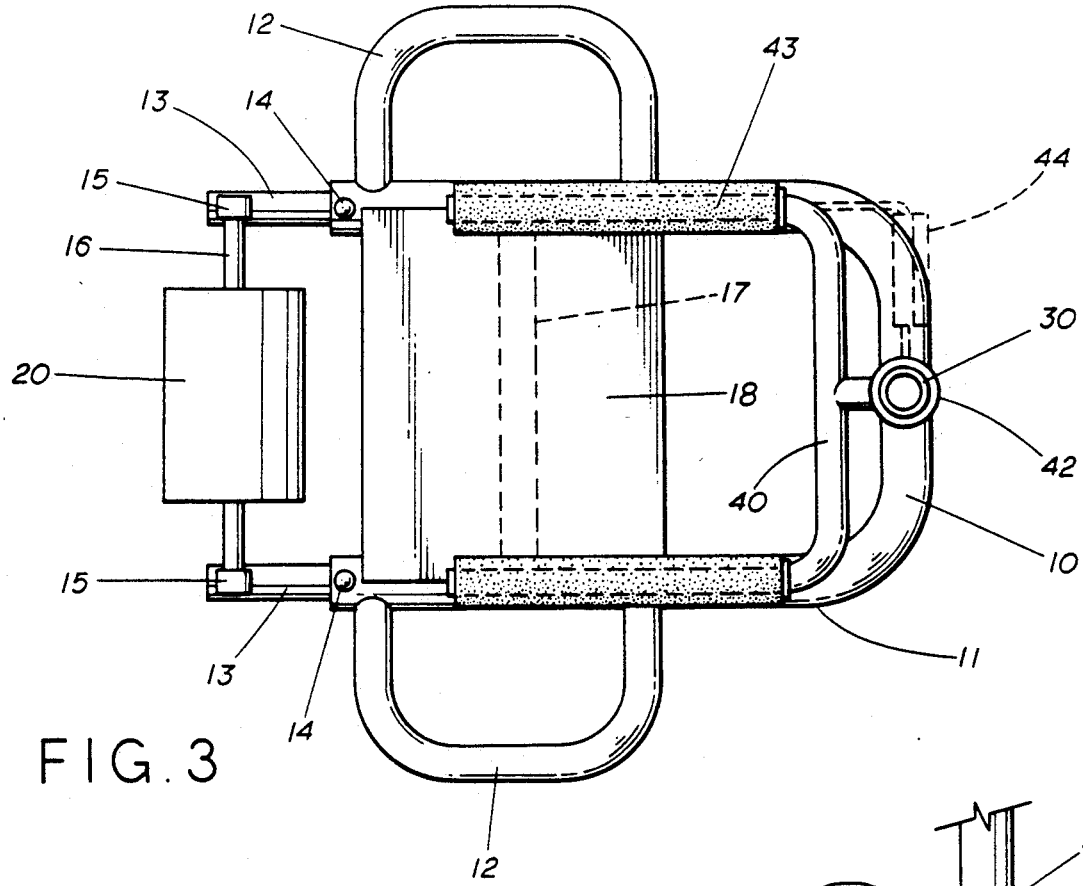
FIG. 3 is a top plan view of the apparatus.

Referring now to FIGS. 1 and 2, the presently preferred embodiment of the invention includes a base generally designated by the numeral 10 which includes a tubular U-shaped portion 11, the lateral extensions 12 and the tubular cylinder supports 13. Lateral extension 12 serve to improve the lateral stability of base 10. Tubular cylinder supports 13 are movable axially toward and away from base 10 and the remainder of the apparatus and the position of tubular cylinder supports 13 may be fixed to U-shaped portion 11 by the base set screws 14. U-shaped portion 11 also supports a reinforcing bar 17 (shown in relief in FIG. 3) and a platform 18 on which a user may stand prior to beginning the use of the equipment.

Tubular cylinder supports 13 support a cylinder 20 by the base uprights 15 and a cylinder axle 16. Cylinder 20 may weigh 35 pounds (16 kg.). The weight of cylinder 20 may vary, and as weight of the cylinder is increased, more effort on the part of the exercising person is required to rotate it at a given speed. Cylinder 20 is mounted on base uprights 15 and cylinder axle 16 for rotation by the feet of the user.

Base 10 supports a vertical upright 30 which in turn supports the generally horizontal handlebars 40 by a pin 31 and a handlebar sleeve 42. Handlebar sleeve 42 seats upon pin 31 by a detent 41 located in the lower edge of handlebar sleeve 42 (as shown in FIG. 2). The height of handlebars 40 from base 10 may be adjusted by removing pin 31 from vertical upright 30, sliding handlebar sleeve 42 to the desired height, and reinserting pin 31 in one of the several pin receiving apertures 32 arranged longitudinally along the central portion of vertical upright 30. Handlebars 40 may each include along the parallel portions thereof the handlebar cushions 43 for the comfort of a person supporting substantially all of his or her weight therefrom. It is to be noted that no portion of handlebars 40 is vertically aligned above cylinder 20.

Handlebar sleeve 42 also supports an electronic readout 44, which may include a timer, an odometer and/or a speed indicator connected by appropriate wiring and switches (not shown) to weighted cylinder 20. Readings on electronic readout 44 may thereby be obtained for the time one has been exercising, the speed at which the exerciser has rotated cylinder 20, the distance traversed along the periphery of cylinder 20, and other measures of exercise known in the art.

Figure 4:
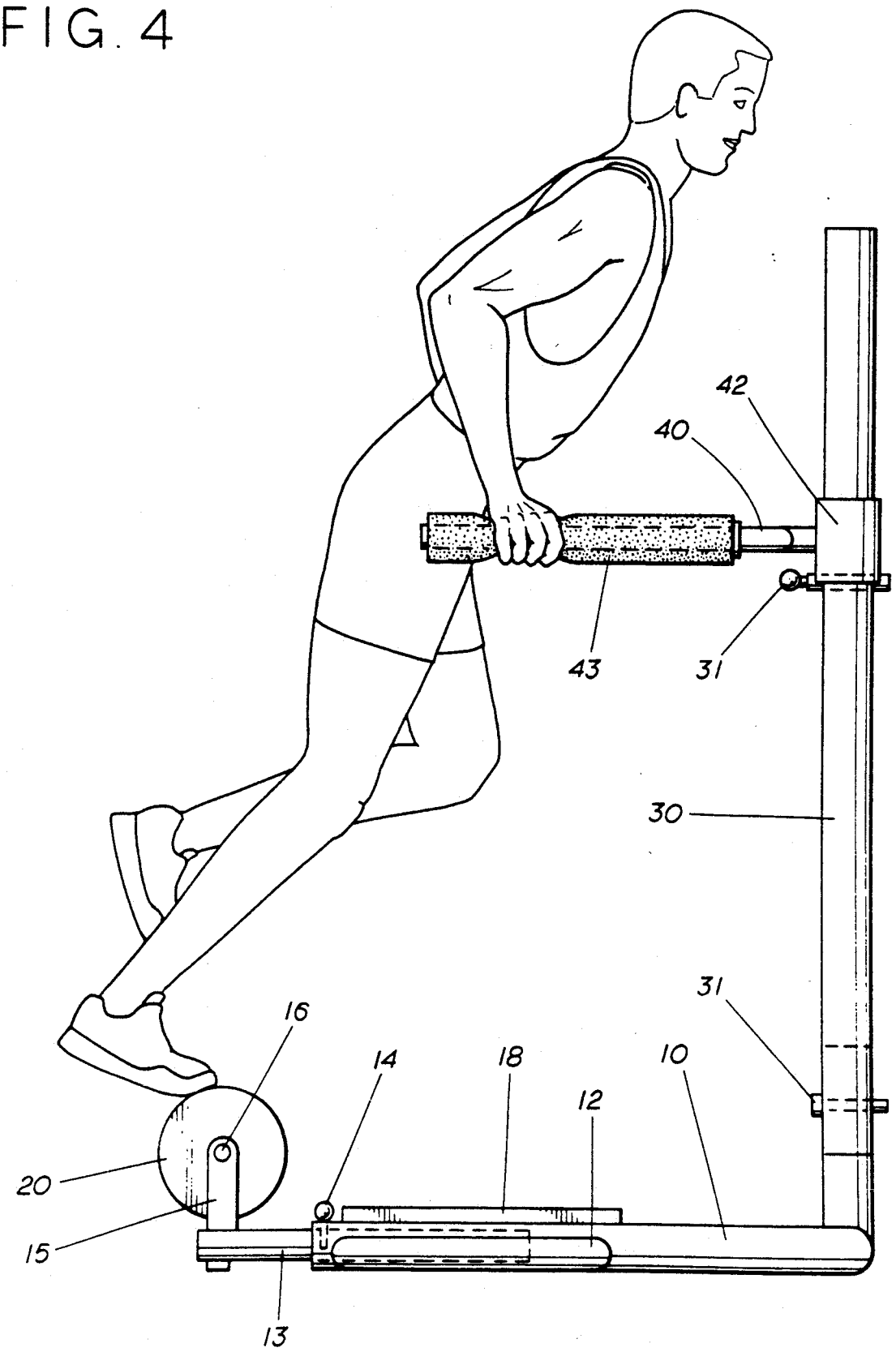
FIG. 4 is a side elevation view of the apparatus showing a person suspending his body partially above and partially below the handlebars while manipulating the weighted cylinder.

In operation, an exerciser may mount the device by standing on platform 18 and grasping handlebars 40 by handlebar cushions 43. If the posture of the exerciser is facing vertical upright 30, the exerciser will assume a substantially erect posture, support a major portion of his or her body weight from handlebars 40 and contact weighted cylinder 20 with the feet. The suspension of the body by the arms and the posture in which the body is placed as a result of the cylinder being outside the vertical alignment of the handlebars caused by isometric tension effect of the combined isometric and aerobic routine. Such a position is shown in FIG. 4. As the exerciser begins a jogging motion with the feet, he begins to turn cylinder 20. The rotation of cylinder 20 causes the aerobic effect of the combination exercise. Suspension of the body in the posture shown in FIG. 4 exercises the triceps, the arm, chest, back, shoulder and stomach muscles. The manipulation of cylinder 20 aerobically exercises calf, thigh and other leg muscles and creates a simultaneous isometric and aerobic exercise.

Figure 5:
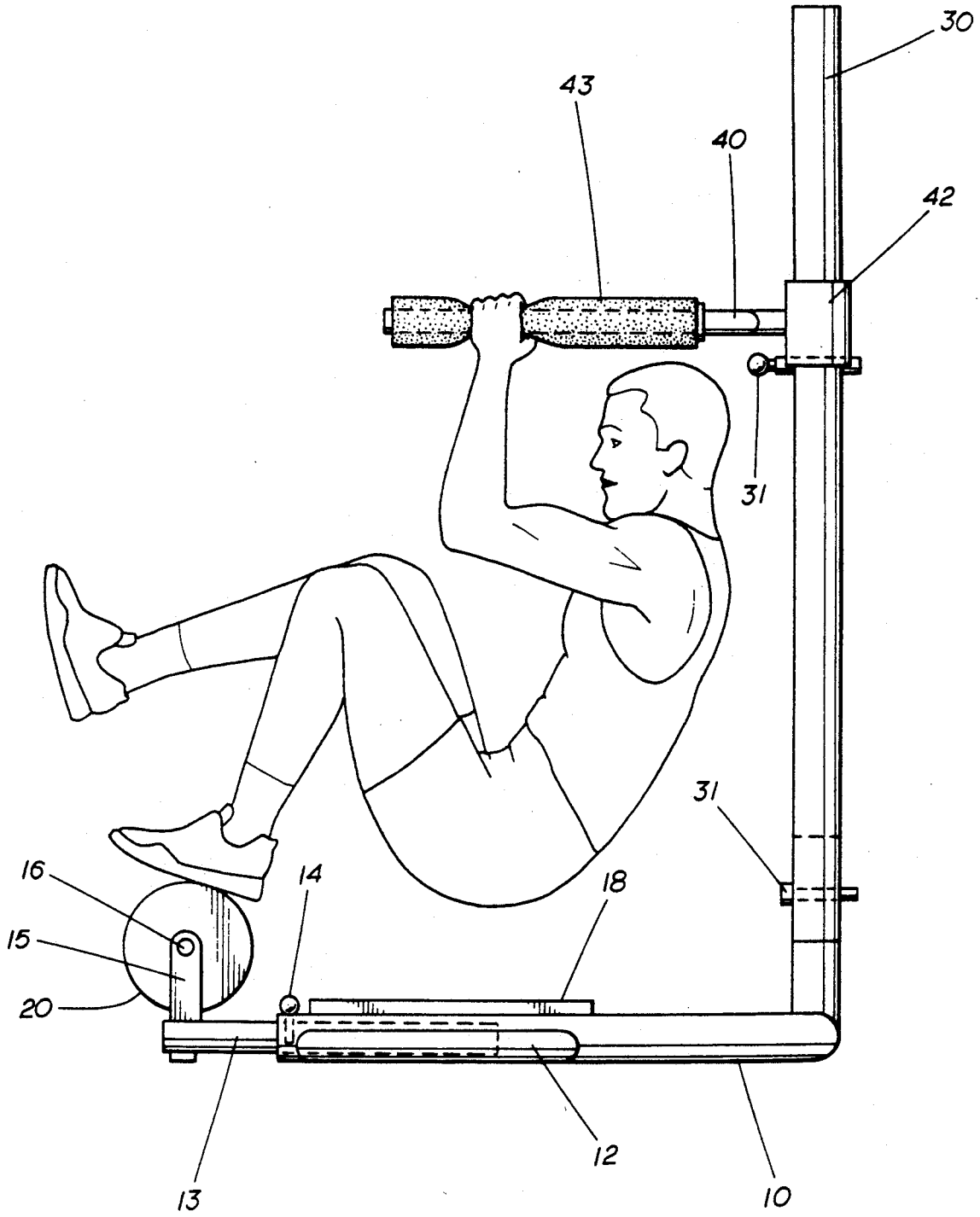
FIG. 5 is a side elevation view of a person suspending his body below the handlebars while manipulating the weighted cylinder; and, FIG. 6 is a side elevation view of the handlebars in a lower position and a person supporting his body above the handlebars in a seated or jack-knife exercise posture.

Referring now to FIG. 5, the hanging or "pull-up" posture of the exerciser is shown with his weight suspended below handlebars 40. The isometric exercise from suspension of body weight is experienced in the forearms, biceps chest, shoulder and stomach muscles. The aerobic cardiovascular conditioning is derived by rotating cylinder 20 with the feet, and when rotation is counter-clockwise as shown in FIG. 5, the thigh, or quadriceps muscle group is the principal leg muscle group involved.

Figure 6:
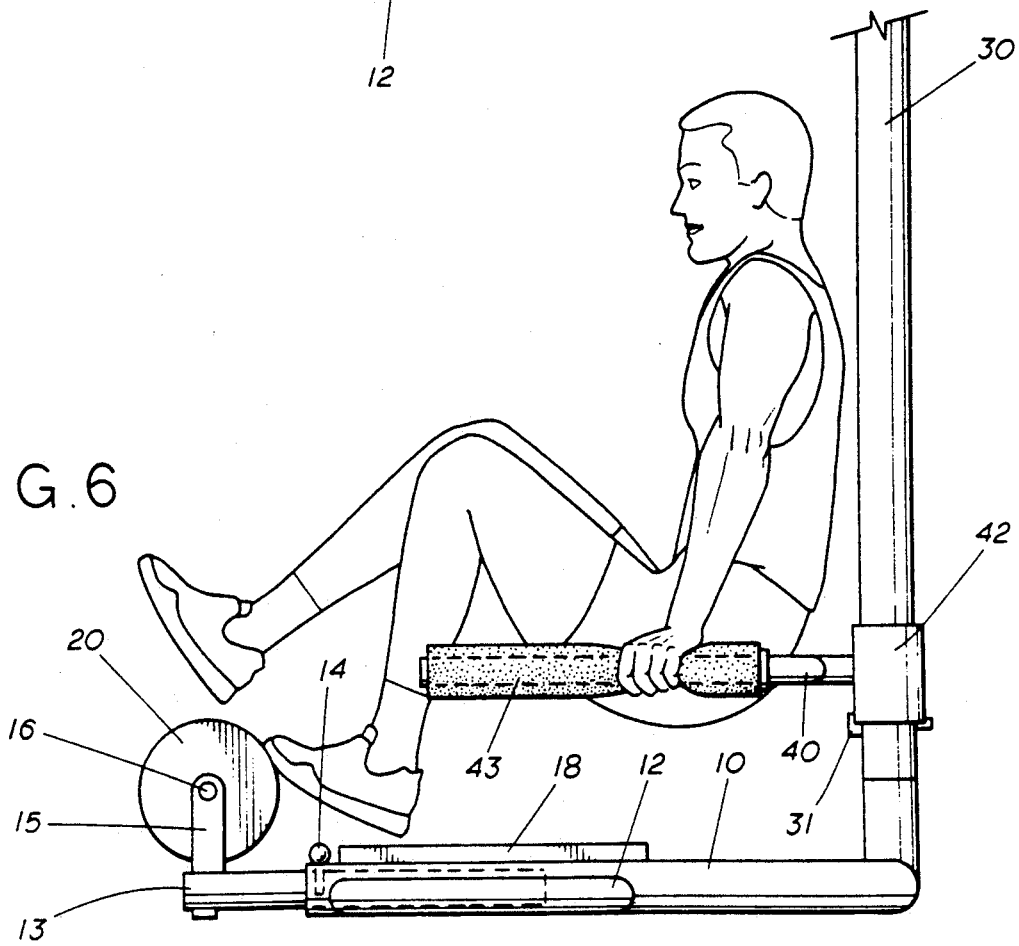

Referring now to FIG. 6, the excerciser suspends his body in a sitting-like position above handlebars 40 and manipulates cylinder 20 counter clockwise with the feet. As shown in FIG. 6, handlebars 40 have been moved to a fixed position on vertical upright 30. The isometric benefit of this posture is experienced in forearms, triceps, shoulders, chest and stomach muscles. The leg muscles mentioned above for the other two postures are the affected muscle groups for the aerobic portion of this exercise posture.

It can now be seen that a novel machine for combined aerobic and isometric exercise has been described. Time, speed and repetitions of exercises and postures on the machine may be varied for greater or lesser work of specific muscle groups. Parts may vary in shape and equivalent parts may be substituted for the parts shown in the drawings and described in the preferred embodiment, all as would be apparent to one skilled in the art.

What is claimed is:

1. An apparatus for combined isometric and aerobic exercise comprising:

a base;

means mounted on said base for supporting the major portion of an exerciser's body weight by the exerciser's arms;

a cylinder supported by said base for engagement and rotation by the exerciser's feet having an axis of rotation transverse to said supporting means and located entirely horizontally offset from said supporting means.

2. An apparatus for combined isometric and aerobic exercise comprising:

a horizontal base;

a generally vertical upright joined to and supported by said base;

handlebars mounted on said upright to support a major portion of the weight of a person utilizing said apparatus, said handlebars being vertically adjustable with respect to said base;

a weighted rotatable cylinder mounted non-vertically aligned with said handlebars and with its axis of rotation transverse of said vertical support for direct engagement with and rotation by the feet of the person; and said axis of rotation of said cylinder being mounted for movement to fixed positions toward and away from said vertical support.

3. The apparatus as claimed in claim 2, wherein:

said handlebars are adjustable from a first height on said vertical upright to permit the person to turn said cylinder with the balls and toes of the person's feet while maintaining his body supported substantially by the person's arms in a substantially erect posture and to permit said person to turn the cylinder with said person's heels while maintaining said person's body hanging below the handlebars in a jack-knifed or seated posture to a second and lower position to permit the person to turn said cylinder with his heels while supporting his body by said handlebars and above said handlebars in said jack-knifed posture.

4. The apparatus as claimed in claim 2, wherein:

said handlebars extend generally horizontally away from said vertical support and parallel to each other along a portion thereof.

5. An apparatus for combined isometric and aerobic exercise comprising:

a horizontal base;

a generally vertical upright joined to and supported by said base;

a weighted cylinder journal for rotation on said base on an axis transverse to said vertical upright;

means for adjusting the horizontal position of said cylinder to fixed positions toward and away from said vertical upright; and, means not vertically aligned with said cylinder fixed to said vertical upright for supporting substantially all the weight of a person manipulating said cylinder with his feet, said supporting means being adjustable vertically with respect to said base to support the person above said supporting means in a first exercise posture and either below said supporting means or partially above and partially below said supporting means in a second exercise posture.

* * * * *